US005146095A

United States Patent [19]

Tsuchiya et al.

[11] Patent Number: 5,146,095

[45] Date of Patent: Sep. 8, 1992

[54] LOW DISCHARGE CAPACITOR MOTOR STARTER SYSTEM

[75] Inventors: Yoshinobu Tsuchiya, Fujisawa; Akihiro Shirata; Hiroyoshi Moroboshi, both of Yokohama, all of Japan

[73] Assignee: Isuzu Motors Limited, Tokyo, Japan

[21] Appl. No.: 501,775

[22] Filed: Mar. 30, 1990

[30] Foreign Application Priority Data

Jun. 14, 1989 [JP] Japan ..... 1-151234

[51] Int. Cl.[5] ..... F02N 11/00

[52] U.S. Cl. ..... 290/38 R

[58] Field of Search ..... 290/38; 123/179 G

[56] References Cited

PUBLICATIONS

J. Kaiser "Electrical Power, Motors, Controls, Generators Transformers," Chapter 9 pp. 145–165 Pub. by Goodheart-Willcox Co., Illinois (1982).

A. E. Fitzgerald et al. "Electric Machinery" Section 11-2, pp. 492 to 497 Pub. McGraw Hill Fifth Edition (1990).

*Primary Examiner*—A. D. Pellinen
*Assistant Examiner*—Lawrence E. Colbert
*Attorney, Agent, or Firm*—Staas & Halsey

[57] ABSTRACT

An engine starter system starts a motor in response to operation of a starter keyswitch. Immediately before the engine is started, a capacitor is manually connected to a power supply such as a storage battery. When the capacitor is charged up to a preset voltage, the electric energy stored in the capacitor is discharged to energize the motor.

5 Claims, 3 Drawing Sheets

LOW DISCHARGE CAPACITOR MOTOR STARTER SYSTEM

BACKGROUND OF THE INVENTION

The present invention relates to an engine starter system for starting an engine in response to operation of a starter switch.

On ordinary motor vehicles such as automobiles, a starter motor for starting the engine is supplied with large electric energy from a battery such a lead storage battery, which is charged by an alternator while the motor vehicle is running. As the lead storage battery is in continuous use, its internal resistance is increased and the battery is self-discharged at an increasing rate. It is known that the service life of normal lead storage batteries is about one year. When the lead storage battery in use is old, it cannot supply a large current to the starter motor at the time of starting the engine, and the battery is likely to run down. The inventor has proposed a power supply system which includes a large-capacitance capacitor that is gradually charged by the electric energy stored in a battery, irrespective of the condition of the battery, and that instantaneously discharges the stored electric energy when the engine is to be started (see Japanese Patent Application No. 63(1988)-329846).

The large-capacitance capacitor which is employed in the proposed power supply system should preferably be an electric double layer capacitor. The electric double layer capacitor has a much greater storage capacity than conventional capacitors and has a physical volume or size which is smaller than one tenth of the conventional capacitors.

If such an electric double layer capacitor is employed as a power supply for producing an instantaneous large current in an engine starter system, then the internal resistance of the electric double layer capacitor should be as small as possible. The electric double layer capacitor comprises a pair of polarized electrodes and a separator in the form of an ion exchange membrane which is interposed between the polarized electrodes. The structural details of the electric double layer capacitor are disclosed in Japanese Patent Publication No. 55(1980)-41015. If an electric double layer capacitor is employed in an engine starter system, the physical volume or size of the capacitor should be small, but its electrostatic capacitance should be as large as possible. Since the volume of a region where a paste of active carbon and an electrolytic solution is present cannot be reduced, attempts are made to make the separator thinner. If the separator is thinned, more electrons pass through the separator. Therefore, with the electric double layer capacitor connected parallel to a battery at all times, a current discharged from the battery always flows through the electric double layer capacitor, with the result that the battery tends to run down soon.

SUMMARY OF THE INVENTION

It is an object of the present invention to provide an engine starter system which minimizes the opportunity for a large-capacitance capacitor to be self-discharged, can start an engine reliably, and prevents a battery from running down soon.

According to the present invention, there is provided an engine starter system comprising a starter motor for starting an engine, a capacitor for supplying stored electric energy to the starter motor to energize the starter motor, power supply means for charging the capacitor, and switch means for normally disconnecting the capacitor from the power supply means, for connecting the capacitor to the power supply means when the capacitor is to be charged by the power supply means, and for discharging electric energy stored in the capacitor to the starter motor when the capacitor is charged up to a preset voltage.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

The principles of the present invention will first be described with reference to FIGS. 1 through 3.

Figure 1:
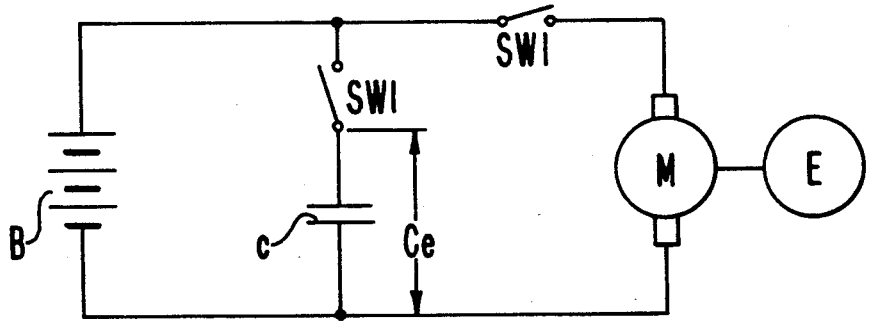
FIG. 1 is a schematic circuit diagram showing an engine starter system according to the present invention.
Figure 2:
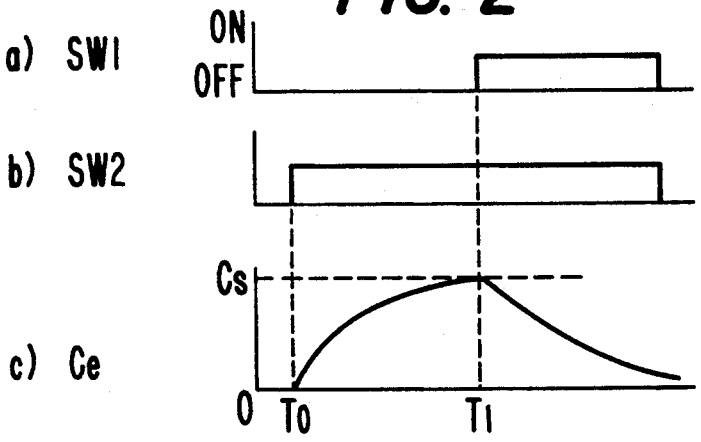
FIG. 2 is a diagram showing how the engine starter system of FIG. 1 operates.

FIG. 1 schematically shows an engine starter system according to the present invention. The engine starter system has a capacitor C which is charged by a power supply B such as a storage battery B, and which discharges its stored electric energy to energize a starter motor M. As shown in FIG. 2, immediately before an engine E is to be started, a normally open switch SW2 is closed to connect the capacitor C to the power supply B at a time T0. When the capacitor C is charged up to a predetermined voltage Cs at a time T1, another switch SW1 is closed to discharge the electric energy stored in the capacitor C to energize the starter motor M. In FIG. 1, the switch SW2 is connected in series with the capacitor C.

Figure 3:
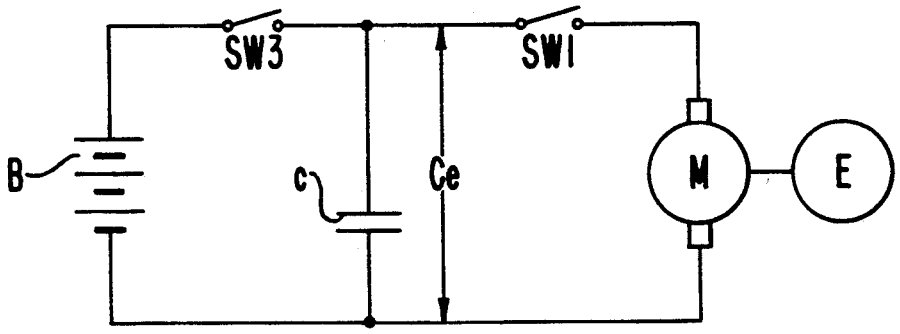
FIG. 3 is a schematic circuit diagram showing another engine starter system according to the present invention.

FIG. 3 schematically shows another engine starter system according to the present invention. In FIG. 3, a normally open switch SW3, instead of the switch SW2, is connected between the power supply B and the capacitor C and parallel to the capacitor C. The switch SW3 is closed at the time TO to connect the capacitor C to the power supply B. When the capacitor C is charged up to the predetermined voltage Cs at the time T1, the switch SW3 is opened to disconnect the capacitor C from the power supply B, and then the switch SW1 is closed to discharge the stored electric energy from the capacitor C to energize the starter motor M.

Now, a specific engine starter system according to the present invention will be described with reference to FIGS. 4 through 6.

Figure 4:
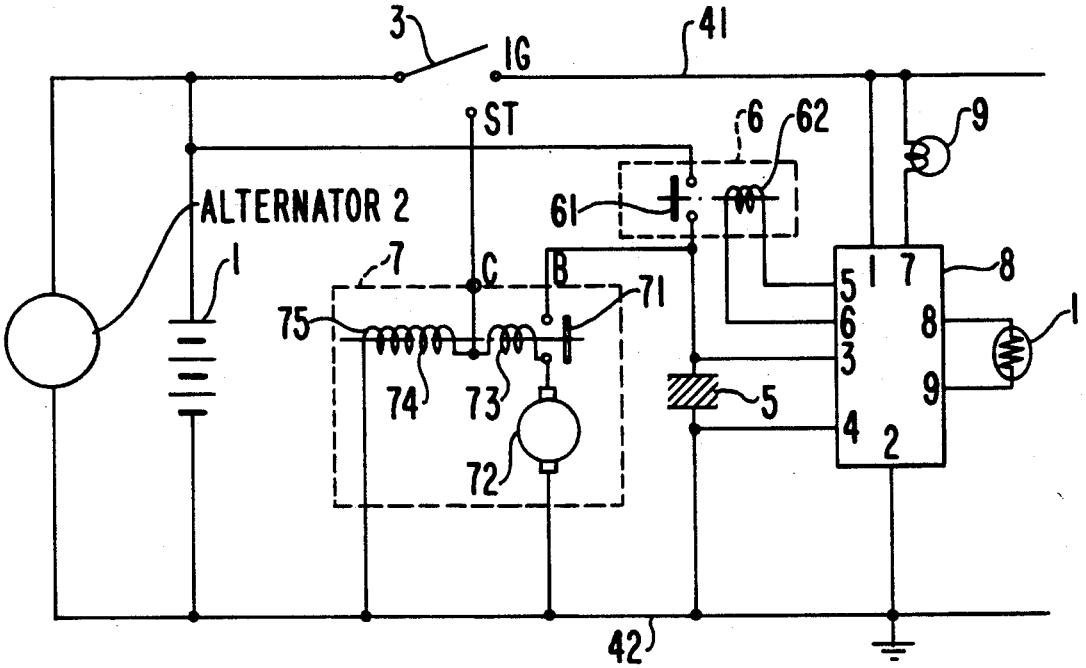
FIG. 4 is a detailed circuit diagram of an engine starter system according to the present invention.

The engine starter system shown in FIG. 4 is based on the principles shown in FIG. 3. A storage battery 1, serving as a power supply for storing electric energy in a capacitor and supplying electric energy to electric devices on a motor vehicle, is connected to an alternator 2 which is drivable by an engine (not shown). Electric energy produced by the alternator 2 is converted into DC electric power, which is stored in the battery 1. A keyswitch 3 is connected in line a 41 which is coupled to the positive terminal of the battery 1 and controls electric connection between the battery 1 and the electric devices on the motor vehicle. The keyswitch 3 has an ignition terminal IG and a start terminal ST.

A large-capacitance capacitor 5 comprises a largesize electric double layer capacitor, which is normally used as a backup power supply for motor vehicle electronic units. The capacitor 5 has an electrode coupled through a relay 6 to the positive terminal of the battery 1 and another electrode to a ground line 42. The relay 6, which corresponds to the switch SW3 shown in FIG. 3, is connected as a normally open switch between the capacitor 5 and the battery 1. The capacitor 5 has an electrostatic capacitance which may be of 10 F (farads), for example. The junction between the capacitor 5 and the relay 6 is connected to a terminal B of a starter unit 7. The starter unit 7 also has a terminal C coupled to the terminal ST of the keyswitch 3. The starter unit 7 has a solenoid-operated relay 71 which supplies electric energy stored in the capacitor 5 to a starter motor 72 after the battery 1 is disconnected from the capacitor 5 by the relay 6. When the engine is to be started, the starter motor 72 is energized by the electric energy which is supplied from the capacitor 5 through the relay 71.

The starter unit 7 also has a coil 73 connected in series with the starter motor 72 between the terminal C and the ground line 42, and another coil 74 connected parallel to the coil 73 and the starter motor 72 between the terminal C and the ground line 42. The coils 73, 74, when energized, magnetically attracts a plunger 75 to move a shift lever, bringing a pinion into mesh with a ring gear for transmitting rotative power from the starter motor 72 to the engine. The relay 6 has a movable contact 61 which can be opened by electromagnetic forces generated by a coil 62. The movable contact 62 is held in a closed position by a controller 8 which is connected between the line 41 and the ground line 42, until the capacitor 5 is charged up to a predetermined voltage.

The controller 8 detects the voltage across the capacitor 5. The controller 8 supplies a current to the coil 62 to keep the movable contact 61 closed until the voltage across the capacitor 5 reaches a predetermined level depending on the temperature of an engine coolant. The controller 8 has a 7th terminal to which the line 41 is connected through a charge indicator lamp 9. The controller 8 also has 8th and 9th terminals between which an engine coolant temperature sensor 10 is connected.

Figure 5:
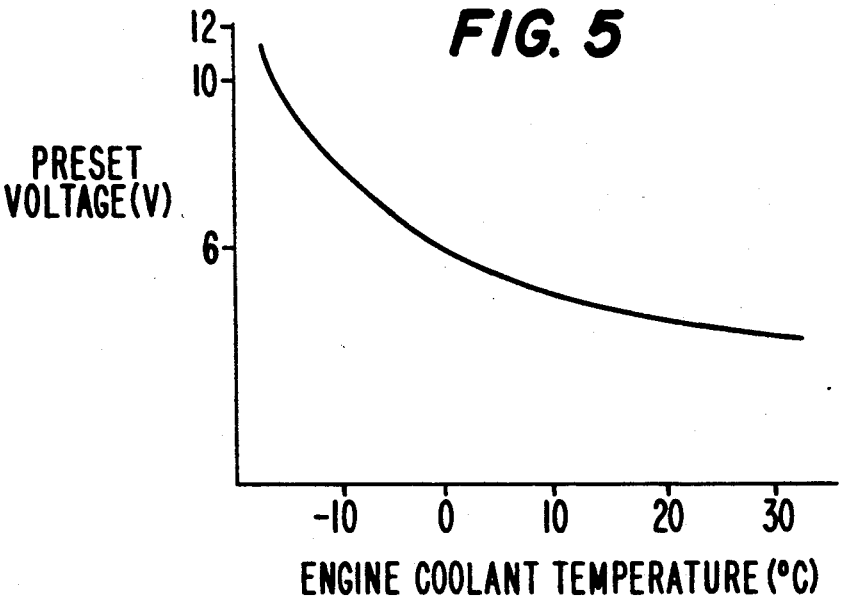
FIG. 5 is a graph showing the relationship between engine coolant temperatures and preset voltages.

FIG. 5 shows the relationship between engine coolant temperatures detected by the engine coolant temperature sensor 10 and preset voltages. The preset voltages are of values necessary to supply a sufficient current, large enough to start the engine, from the capacitor 5 to the starter motor 72, and are inversely proportional to the engine coolant temperature.

Figure 6:
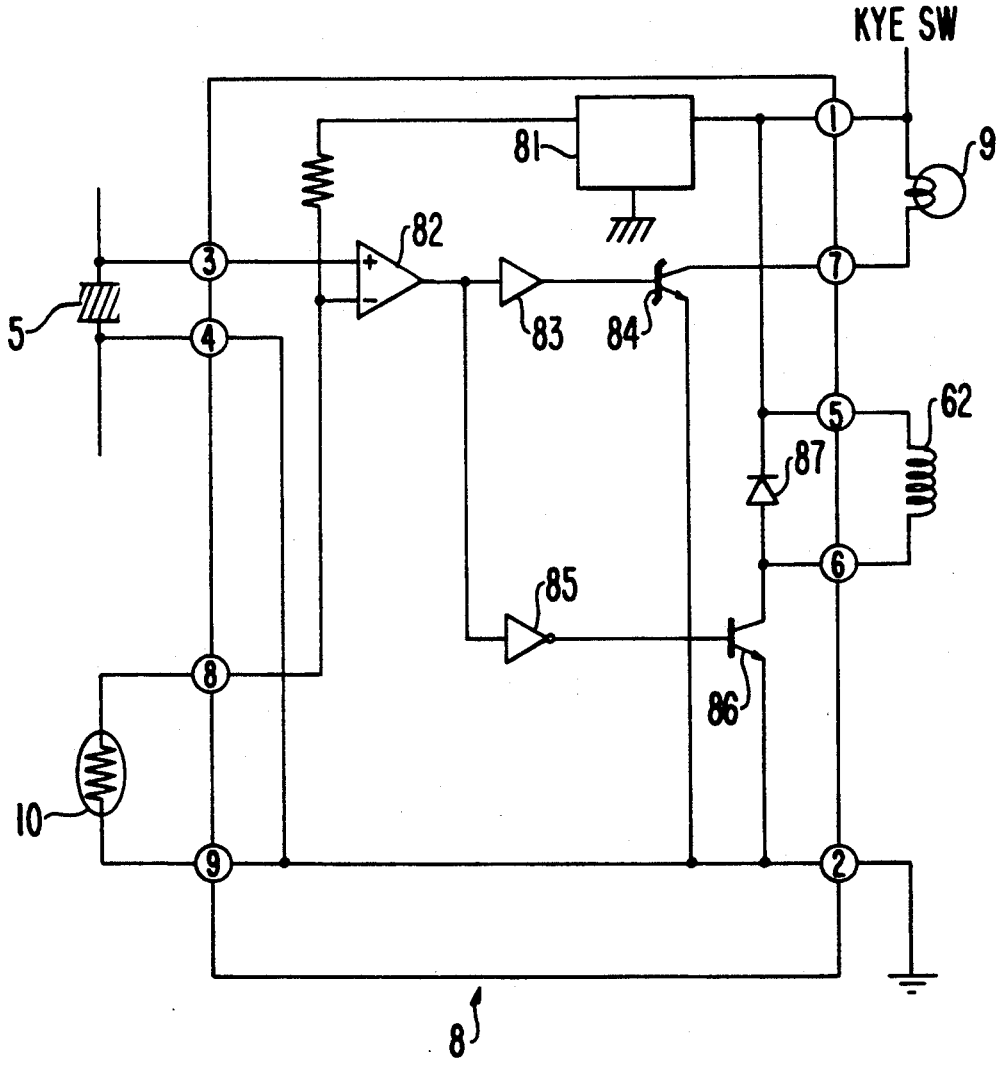
FIG. 6 is a circuit diagram of a controller in the engine starter system illustrated in FIG. 4.

FIG. 6 shows in detail the circuit arrangement of the controller 8.

The controller 8 has a regulated constant-voltage power supply 81. The voltage across the capacitor 5 is applied through a 3rd terminal to a comparator 82 by which it is compared with the voltage from the regulated constant-voltage power supply 81. An output signal from the comparator 82 is supplied through a buffer 83 to the base of a transistor 84 and also through a NOT gate 85 to the base of a transistor 86. When the transistor 84 is turned on, the charge indicator 9 is energized. Since the transistor 86 is de-energized, no current flows through the coil 62, and hence the movable contact 61 of the relay 6 remains closed. When the capacitor 5 is charged up to the predetermined voltage, the output signal of the comparator 82 is inverted, and the coil 62 is energized to open the movable contact 62.

Operation of the engine starter system of the above construction will be described below.

In FIG. 4, the keyswitch 3 is shown as being open, and the engine is not in operation. Now, the keyswitch 3 is closed in order to start the engine. When the movable contact of the keyswitch 3 is brought into contact with the ignition terminal IG, a voltage from the battery 1 is applied between 1st and 2nd power supply terminals of the controller 8, which is energized to check the voltage across the capacitor 5.

If the checked voltage across the capacitor 5 is not high enough to start the engine, i.e., if it is lower than a preset voltage, then the relay 6 remains turned on, and the charge indicator lamp 9 also remains energized.

The capacitor 5 is continuously charged by the battery 1. When the voltage across the capacitor 5 reaches the preset voltage or more, the controller 8 de-energizes the charge indicator lamp 9, letting the vehicle driver know that the engine can be started. Then, the driver turns the keyswitch 3 until its movable contact is brought into contact with the start terminal ST to energize the starter motor 72 to start the engine. More specifically, a current from the battery 1 flows through the terminal ST and the terminal C to the coils 73, 74. The starter motor 72 is slowly rotated to magnetically attract the plunger 75, thus bringing the pinion into mesh with the ring gear. The relay 71 is closed to allow the electric energy stored in the capacitor to flow from the terminal B to the starter motor 72. Therefore, the starter motor 72 is supplied with the electric energy which is large enough to start the engine.

When the starter motor 72 is energized, the relay 6 may be either de-energized or continuously energized.

More specifically, if the capacitor 5 is sufficiently charged and the engine can be started with the current which is discharged from only the capacitor 5, then the relay 6 is de-energized and the starter motor 72 is energized with the electric energy from the capacitor 5. In this manner, the battery 1 is prevented from being consumed soon. If the capacitor 5 is not sufficiently charged, the relay 6 is continuously energized so that the starter motor 72 is energized by both the battery 1 and the capacitor 5.

The engine coolant temperature sensor 10 detects the condition of how the engine is cooled. The controller 8 may keep the relay 6 energized when the detected temperature of the engine coolant is below a predetermined temperature. Therefore, if the engine coolant temperature is lower than the predetermined temperature, the starter motor 72 is energized by both the battery 1 and the capacitor 5. If the engine coolant temperature is higher than the predetermined temperature, then the relay 6 is de-energized and the starter motor 72 is energized by only the capacitor since the torque required to start the engine may be smaller.

If the voltage of the battery 1 is high, the discharge of the capacitor 5 may be obstructed by the battery voltage. To avoid this drawback, a relay contact may be connected between the positive terminal of the battery 1 and the line 41 and may be actuated in ganged relation to the relay 71 to temporarily disconnect the battery 1 from the capacitor discharging circuit.

The charge indicator lamp 9 may be dispensed with, and the controller 8 may automatically connect the terminal ST of the keyswitch 3 to the battery 1 when the battery across the capacitor 5 reaches the preset voltage.

With the arrangement of the present invention, the electric double layer capacitor, which generally produces a large self-discharged current, is connected to the battery only immediately prior to the starting of the engine. Since the electric energy stored in the capacitor is discharged when the engine is started and the capacitor is charged only before the engine is to be started, the opportunity for the capacitor to be self-discharged is minimized. The capacitor is not required to have a very large capacitance, and hence a large volume and weight. The capacitor is reliable in energizing the starter motor to start the engine. As the battery is not always connected to the capacitor, the battery is less liable to run down soon.

Although a certain preferred embodiment has been shown and described, it should be understood that many changes and modifications may be made therein without departing from the scope of the appended claims.

What is claimed is:

1. A starter system for a motor, comprising:

a large-capacitance capacitor electrically connectable to the motor for supplying stored electric energy to the motor to energize the motor;

power supply means for charging said capacitor; and switch means for normally disconnecting said capacitor from said power supply means, for connecting said capacitor to said power supply means when the capacitor is to be charged by the power supply means, and for discharging electric energy stored in said capacitor to the motor when said capacitor is charged up to a preset voltage.

2. An engine starter system according to claim 1, further including charge indicator means for indicating that said capacitor is charged up to the preset voltage, and connection controlling means for connecting said starter motor to said power supply means depending on the indication of said charge indicator means.

3. An engine starter system according to claim 1, further including voltage setting means for setting said preset voltage depending on the temperature of a coolant for the engine.

4. An engine starter system according to claim 1, wherein said capacitor comprises an electric double layer capacitor.

5. A starter system for an automotive engine including a starter motor operatively coupled to the engine to deliver a starting force to the engine, said system comprising:

a battery having a stored supply of electric energy;

an electrical circuit electrically coupled to the battery and the starter motor and including a large-capacitance capacitor chargeable by the electric energy of the battery, said capacitor being normally disconnected from the battery and the starter motor;

a manual switch movable between first and second positions;

a first switch disposed in the electrical circuit and being operable to normally disconnect the capacitor from the battery and to connect the battery to the capacitor when the manual switch is in the first position, thereby charging the capacitor with electric energy to a predetermined voltage level; and a second switch disposed in the electrical circuit and being operable to normally disconnect the capacitor from the battery and to connect the capacitor to the starter motor when the predetermined voltage level has been achieved when the manual switch is in the second position, thereby discharging the electric energy stored in the capacitor to the starter motor.

* * * * *